United States Patent [19]

Schippers

[11] 4,019,311

[45] Apr. 26, 1977

[54] PROCESS FOR THE PRODUCTION OF A MULTIFILAMENT TEXTURIZED YARN

[75] Inventor: Heinz Schippers, Remscheid, Germany

[73] Assignee: Barmag Barmer Maschinenfabrik Aktiengesellschaft, Wuppertal, Germany

[22] Filed: July 16, 1974

[21] Appl. No.: 488,948

[30] Foreign Application Priority Data

July 18, 1973 Germany ..... 2336509

[52] U.S. Cl. ..... 57/140 BY; 57/157 TS; 264/103; 264/143; 264/171; 264/210 F; 428/376; 428/399

[51] Int. Cl.[2] ..... D02G 3/04; D01D 5/12

[58] Field of Search ..... 264/210 F, 103, 143, 264/171; 428/376, 399; 57/140 BY, 157 TS, 157 S

[56] References Cited

UNITED STATES PATENTS

| | | | |
|---|---|---|---|
| 2,003,400 | 6/1935 | Taylor et al. | 57/157 TS |
| 2,262,872 | 11/1941 | Whitehead | 264/103 |
| 3,111,805 | 11/1963 | Boyer | 264/171 |
| 3,117,906 | 1/1964 | Tanner | 264/171 |
| 3,120,027 | 2/1964 | Baggett et al. | 264/210 F |
| 3,264,390 | 8/1966 | Tanner | 264/171 |
| 3,486,318 | 12/1969 | Cannon et al. | 57/34 |
| 3,553,305 | 1/1971 | Au | 264/210 F |
| 3,555,808 | 1/1971 | Gutmann | 264/210 F |
| 3,558,757 | 1/1971 | Denyes et al. | 264/103 |
| 3,707,593 | 12/1972 | Fukada et al. | 264/210 F |
| 3,719,442 | 3/1973 | Schippers et al. | 425/66 |
| 3,771,307 | 11/1973 | Petrille | 57/157 TS |
| 3,840,630 | 10/1974 | Yamada et al. | 264/103 |
| 3,846,532 | 11/1974 | Kubitzker et al. | 264/210 F |
| 3,857,233 | 12/1974 | Cardinal et al. | 57/140 R |

FOREIGN PATENTS OR APPLICATIONS

| | | | |
|---|---|---|---|
| 45-1932 | 1/1970 | Japan | 264/210 |
| 42-8728 | 4/1967 | Japan | 264/171 |

OTHER PUBLICATIONS

B292,300, Jan. 1975, Reese.

*Primary Examiner*—Jay H. Woo
*Attorney, Agent, or Firm*—Johnston, Keil, Thompson & Shurtleff

[57] ABSTRACT

A process for the production of a multifilament textured yarn by melt-spinning different polymers (for example a polyamide and a polyester) or copolymers (for example copolymers of nylon-6 and nylon-6,6) to form a highly preoriented multifilament yarn at substantially the same draw-off rate for all the constituent filaments of the yarn, followed by stretching under substantially the same stretching conditions for all the constituent filaments of the yarn, the stretching ratio lying above the elastic limit of at least one of the spun polymers and the preorientation of the freshly spun filaments being sufficient to provide a maximum stretching ratio available in the stretching stage of not more than 1:2.5, i.e. not more than 2.5 times the unstretched or spun length of filaments. Yarns are produced which may have the appearance of texturized continuous multifilament yarns or crimped staple fiber yarns.

14 Claims, 11 Drawing Figures

SIDE-BY-SIDE

ECCENTRIC

CONCENTRIC

PROCESS FOR THE PRODUCTION OF A MULTIFILAMENT TEXTURIZED YARN

Figure 1:
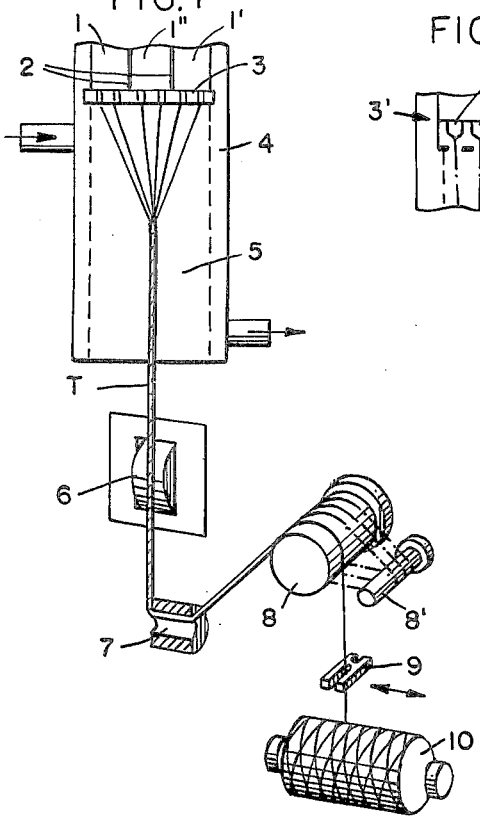

Multifilament textured yarns can be produced by spinning two or more polymers differing from one another in their linear behavior in the form of individual filaments and combining them to form a yarn or spinning them in the form of bicomponent or so-called composite filaments or fibers. Since, in both cases, the combined components form a homogeneous length of filament, the "longer" component is forced by the different linear behavior of the components to wrap itself in turns around the "shorter" component. This provides the resulting yarn with crimp, bulkiness and voluminosity.

It is known that the differential linear behavior is caused by the type of polymers used (for example Austrian Pat. No. 228,919, French Pat. No. 1,416,022 or U.S. Pat. No. 3,099,174), by the viscosity of the spinning melts (British Pat. No. 969,110), by additives (British Pat. No. 1,128,536) and various other treatments (for example British Pat. No. 1,087,823 or British Pat. No. 1,028,873). The differential linear behavior can be produced simply by stretching the yarn or the bicomponent filament (for example as disclosed by Austrian Pat. No. 228,919) or by a subsequent shrinkage treatment carried out in the absence of tension (British Pat. No. 950,429 or by a swelling treatment (French Pat. No. 1,205,162). It is also known that linear behavior is influenced by a differential orientation in identical or different polymers. Thus, according to U.S. Pat. No. 2,439,814, differential linear behavior is obtained through differential orientation by stretching a bicomponent filament of different polymers to beyond the elastic limit of one of the two components. According to German Pat. No. (DOS) 2,052,729, differential orientation (double refraction) is obtained in filaments of the same kind which have been spun together by applying a different conveying force to certain portions of the filament bundle or tow.

The processes and texturized yarns described above can only be effectively used for certain applications. The object of the present invention is to provide an additional process for producing texturized crimped filaments suitable for use in a wide range of applications. More particularly, the object of the invention is to enable standard polymers to be used without any need for special pretreatments and additional treatments under substantially the same spinning and stretching conditions, so that the components of the yarn can be run off from the spinning zone and stretched together without any differences between them, i.e. under the same operating conditions.

To achieve this object, the invention is based upon a process for the production of a multifilament textured yarn by simultaneously melt-spinning different polymers or copolymers to form a continuous, preoriented multifilament tow or yarn at substantially the same spinning conditions, including the same take-off rate for all the filaments of the tow, followed by stretching of the spun and solidified tow under substantially the same stretching conditions, the stretching ratio being increased beyond the elastic limit of at least one of the two polymers. According to the invention, the present process is distinguished by the application of melt-spinning conditions which promote such high preorientation of the individual spun filaments that the available maximum stretching ratio of the filamentary polymers in the subsequent stretching stage amounts to less than 1:2.5.

The level or range of preorientation developed in the spinning stage is a factor which, in the following stretching stage, determines the elastic limit as the lower limit to the stretching ratio and also determines the maximum stretching ratio, i.e. that stretching ratio which results in breakage. According to the invention, stretching is intended to lie within this range of stretching ratios for at least one polymer of the multifilament yarn or tow made up of the filaments of several polymers.

It has surprisingly been found that, under the required spinning conditions promoting the specified high preorientation of the individual polymers, one achieves differential elongation, elasticity and shrinkage properties to a markedly increased extent in the polymers. This is primarily attributable to the fact that very different maximum stretching ratios of the individual components are formed precisely in the specified range of high preorientation, i.e. neither above this range nor below it. These differences in the maximum stretching ratios lead to correspondingly high differences both in the elastic elongation or extension portion of stretching and also in the shrinkage capacity of the distinct filaments. These differences in the maximum stretching ratios can be further intensified by simultaneously spinning filaments of different yarn size, i.e. denier or diameter, which produces different tendencies in regard to preorientation. For this purpose, the polymer which already has a higher, maximum stretching ratio than the other polymer (for example the polyester as against polyamides, or nylon-6 as against nylon-6,6) should have the coarser denier or larger diameter, and hence should show lower preorientation and, accordingly, a higher maximum stretching ratio.

As will be appreciated from the foregoing, the crimp of the yarns produced in accordance with the invention is actually developed by stretching. However, it is also advisable, depending upon the type and modification of the fiber-forming polymers used, to carry out a shrinkage treatment or any other aftertreatment in the absence of tension on completion of the stretching stage.

Heavily preoriented filaments are preferably obtained by applying a draw-off rate in the melt spinning zone of more than 2500 m/minute. The draw-off rate is the rate at which the filaments are run off or taken off from the spinneret by godets or by a take-up bobbin or the like. The draw-off rate is higher than the spinning rate at which the molten polymers are extruded from the spinneret. The draw-off rate has a considerable bearing upon preorientation. The high level of preorientation required by the invention is promoted by spinning filaments of fine individual yarn sizes (spinning deniers), for example, yarn sizes of less than 2.5 denier. As additionally proposed, the necessary high preorientation is also aided by subjecting the bundle or tow of filaments to a quenching treatment below the spinneret, i.e. directly after the extrusion of the filaments so as to cool and solidify the filaments as quickly as possible.

The preferred range of draw-off rates lies between 2700 m/minute and 4500 m/minute.

In one advantageous embodiment of the process of the invention, the stretching is increased to beyond the maximum stretching ratio of one polymer component, i.e. one or more of the different polymer filaments provided that at least one polymer is maintained below its maximum stretching ratio. As a result, the polymer component stretched to exceed its maximum stretching ratio (break point) tears or ruptures and is reduced into short fibers, irrespective of whether it is an individual or single component filament or part of a bicomponent filament. In this way, the tow partly assumes the character of a staple fiber yarn. This process affords particular advantages when used in conjunction with the process according to the invention in regard to production reliability and also to the quality of the product by virtue of the high discrepancy between the maximum stretching ratios of the strongly preoriented polymers. Another particular advantage in this respect is that, due to the high level of preorientation, the maximum stretching ratio is substantially unaffected by temperature so that stretching can be carried out at the optimum temperature for the continuous component, i.e. the filamentary polymer component which does not tear or break.

In this connection, the multifilament tow can be advantageously guided over an edge wheel in the stretching stage. The radially projecting edges of the wheel, preferably as sharp cutting edges, are distributed at irregular or regular intervals around the circumference of the wheel and to determine specific breakage points along the filament component which is torn or ruptured.

The non-tearing filament component can be stretched up to about the maximum stretching ratio. It is of advantage for the non-tearing component to be stretched by less than its maximum stretching ratio, because this component will then show a good tendency towards crimping which adds favorably to the bulk or texturized voluminosity of the yarn.

The advantage of the process according to the invention is that a multicomponent filamentary yarn, especially a synthetic thermoplastic yarn, is obtained from standard polymers which can be produced chemically with predetermined properties and which can be spun, stretched and otherwise treated as individual filaments together without any need for process modifications or special treatments. This advantage is accomplished by high productivity by virtue of the high draw-off rates in the spinning stage. The high level of preorientation further promotes the common production and processing of filaments of different polymers because the strongly preoriented polymers are largely unaffected by temperature, whereas polymers with a low preorientation, for example polyesters, undergo considerable embrittlement or other unfavorable changes under the influence of elevated temperatures. Accordingly, it is always possible to apply the optimum temperatures for the "carrying" or continuous filament component which is primarily responsible for tear strength, elongation and other desirable physical properties of the yarn.

As already mentioned, the process according to the invention can be used for producing a crimped and bulked yarn in which the individual filaments each consist of one of the different polymers or copolymers. In the production of a yarn of this kind, it has proved to be of advantage and even advisable to combine the individual filaments in such a way that the group of filaments of the one polymer surrounds the group of filaments of the other polymer on at least two sides. The object of this partial or complete enclosure is to prevent the bundle or tow of filaments from disintegrating or separating entirely into groups of its "longer" and "shorter" components.

In addition to this, however, it is necessary in the production of a bulked or crimped yarn, in which the individual filaments each consist of one of the different polymers, to establish a certain bond or cohesiveness between the individual filaments. On the one hand, such cohesiveness is required to produce a uniform yarn and, on the other hand, one must ensure that the differential linear behavior of the polymers provides the total yarn with crimp, bulk and voluminosity. To this end, a false twist is advantageously imparted to the bundle or tow of freshly spun filaments in the spinning zone, for example by a friction false twister arranged immediately in front of the drawoff unit (godet, take-up bobbin or the like), the twist running back into the cooling zone where the spun filaments are solidified.

When the process according to the invention is used for the production of a textured yarn in which the individual filaments are in the form of bicomponent or multicomponent fibers, it is possible to use any of the well known bicomponent configurations or structures, e.g. in particular a side-by-side structure or an eccentric core/mantle structure. However, a concentric core/mantle structure is also of particular advantage in that the adhesion of the different polymers, which is known to present considerable difficulties in the production of bicomponent filaments (cf. for example. U.S. Pat. No. 3,039,174, column 1, lines 42 et seq. line 69), is assured without any need for further measures. The mantle which is uniformly thick on all sides results in an increased reliability of production and, hence, in an improved quality and uniformity of the bicomponent fibers.

Favorable co-operation between bulking and crimping effects can also be obtained if, according to another aspect of the invention, the yarn or tow is made up of single-component filaments and multicomponent filaments. In this case, the single-component filaments can consist for example of a polyester and the multicomponent filaments can consist of a nylon-6 and a nylon-6,6 in any cross-sectional configuration.

It has already been mentioned that stretching of the bicomponent filaments can be followed by a shrinkage treatment or some other aftertreatment carried out in the absence of tension.

The false-twist crimping process, sometimes referred to as a durable, heat-set torque crimping, is generally well known and has proved to be a particularly advantageous aftertreatment within the scope of the process according to the present invention for the production of textured yarns. The tow can be subjected to false-twisting after stretching (for example, see British Pat. No. 848,798) or during stretching (for example, see British Pat. No. 777,625). It is especially desirable to employ the procedures for false-twisting a bicomponent or multicomponent yarn as taught in my earlier copending U.S. application, Ser. No. 328,429, filed Jan. 31, 1973, the disclosure of which is incorporated herein be reference as fully as if set forth in its entirety. In particular, one can advantageously spin, stretch, false-twist, heat-set and take up the treated and fully texturized yarn in one continuous operation at high speed without subjecting the filaments or the yarn to any additional shrinkage treatment, i.e. by maintaining at least some minimal tension on the yarn in each continuous step of the process.

Conventional false-twist crimping processes, including the subsequent heat-treatment or heat-setting stage, are described for example by Scherzberg in "Texturierte Garne" published in 1968 by Melliand. See also Chapter 2 of "Woven Stretch and Textured Fabrics" by Hathorne, Interscience Publ., John Wiley and Sons, N.Y. (1964). The false-twist applied is of the same order as that applied to conventional initial melt-spun and stretched yarns and amounts, for example, to about 5000 turns per meter of filament length (T/m) for a yarn size of 22 dtex, and to at least 2000 T/m for a conventional 167 dtex yarn. The heat treatment of the yarn which may take place both in and after the false-twist zone is also governed by the usual values.

The combination of the various process stages described thus far affords a number of advantages which, together, result in increased productivity and quality of the resulting crimped and bulked yarn. One particular advantage is that, in the case of heavily preoriented filaments, the stretching forces are considerably lower when a twist is simultaneously introduced than those forces which must be applied in a stretching of weakly preoriented filaments without simultaneous false-twisting.

Above all, however, application of the false-twist crimping treatment to a yarn which already has a tendency towards crimping inherent in its bicomponent structure affords a significant advantage which may be explained as follows:

Crimping of the yarns made up of filaments of different polymers or copolymers is determined both by the structure of the yarn and by the elasticity, elongation and shrinkage characteristics of the different polymer components. The degree of crimp and bulkiness can only be adapted to the particular application or end use envisaged within certain narrow limits, for example only by modifying the stretching treatment and other aftertreatments.

By contrast, crimp and bulk yarns with a variety of different properties and a wide range of applications can be obtained by the false-twist crimping process. However, the industrial false-twist crimping process as practiced today has reached a limit in terms of productivity. Nowadays false-twisting is largely carried out by means of so-called magnetic false-twist spindles which reach rotational speeds of 1 million r.p.m. in processing relatively fine denier yarns. Therefore, if a 22 dtex yarn or thread is to be false-twist-crimped with 5000 T/m, the rate of thread travel in this case is limited to a maximum of 200 m/minute. Higher numbers of turns per meter of thread length and, hence, higher rates of thread travel as well can be obtained by using well-known friction false twisters which impart a twist to the thread by a rotating peripheral drive surface. However, a certain amount of slip between the surface of the friction twister and the surface of the thread or yarn is inevitable in this case, and unfortunately the degree of this slip cannot be kept constant. This means that the twist of the yarn is also not constant over its length, resulting in varying crimps which greatly reduce the quality of the end product. By using a self-crimping yarn in such a false-twist crimping process, it is possible to eliminate the adverse effect of slip which also occurs at relatively high rotational speeds in those cases where magnetic false-twist spindles are used. A more uniform and high quality end product become possible only because false-twist crimping and the natural or inherent tendency towards crimping of bicomponent filaments are not only superimposed but they also complement one another with the false-twisting being adapted to a certain extent to the natural tendency of the yarn towards crimping.

The natural tendency towards crimping of the yarn made up of two or more different polymers, which is evidenced in the fact that the "longer" component of the yarn wraps itself around the "shorter" component in repeated turns and preferably in helical turns, is triggered or self-initiated by the false-twist treatment and then further promoted by the heating that accompanies false-twisting and by the stretching operation which may be optionally carried out at the same time. The effect of this essentially simultaneous development of the natural or inherent crimp and the crimp applied by false-twisting, with an adaptation of the false-twist crimping to the natural tendency towards crimping, is that fluctuations in the structure and linear characteristics of the yarn are largely neutralized and a uniformly crimped and bulky yarn is favorably formed with uniform dyeing as well as physical properties, even at extremely high production rates in the false-twist crimping stage. The increased production rate in the false-twist crimping stage made possible in this process outweights by far the increased cost of initially producing a multi- or bi-component yarn made up of several polymers.

The advantage of applying the false-twist crimping process is also demonstrated in particular in those yarns produced in accordance with the invention with a symmetrical arrangement of the filament groups consisting of the different individual polymers or with a symmetrical core/mantle cross-sectional configuration of the individual bicomponent filaments. A natural or inherent tendency towards crimping of symmetrical yarn structures of this kind is almost impossible to develop with conventional stretching and shrinkage treatments. The reason for this residues in the fact that, corresponding to the symmetrical cross-section of the yarn or individual filaments, a symmetrical axial tension zone is also formed in the structured yarn or individual filaments. For this reason, crimping cannot occur as an inherent or latent property of the yarn or filaments. Under the effect of false-twisting, the hitherto axially directed load of the yarn is converted into a helical load which, in mechanical terms, results in a torsional buckling or deformation of the yarn and/or its individual filaments. Accordingly, the advantages of the symmetrically structured yarns and bicomponent filaments made up of several polymers, especially including an improved cohesion of the yarn and a better adhesion of the polymer components in the bicomponent filaments and also a greater reliability of production, can only be fully brought to bear by applying the false-twist crimping process to yarns or filaments of this kind as proposed in accordance with the process of the present invention.

Figure 1A:
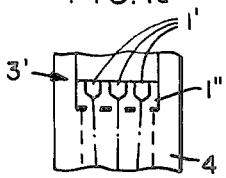
Figure 2:
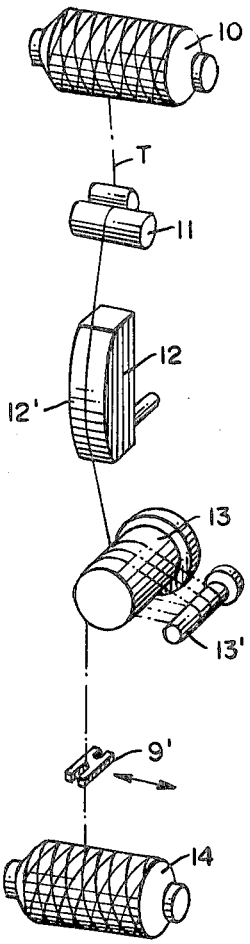
Figure 3:
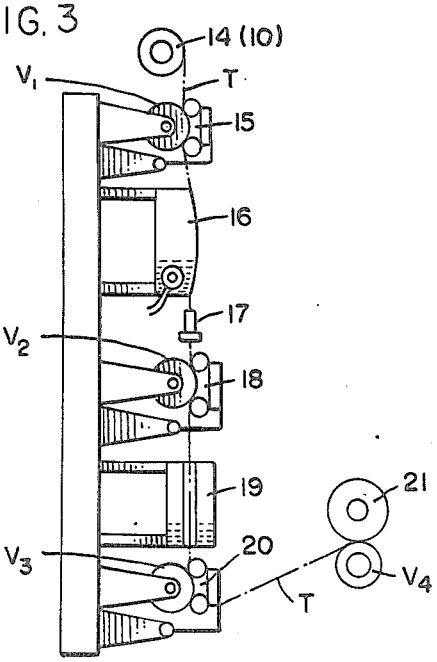
Figure 4:
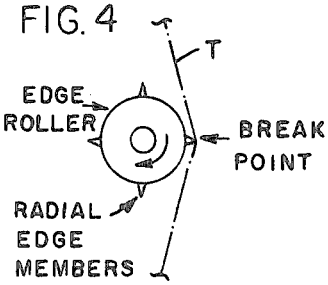
Figure 5A:
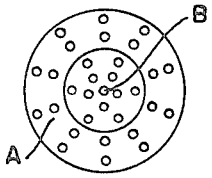
Figure 5B:
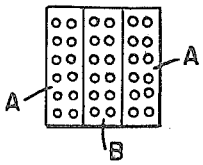
Figure 6A:
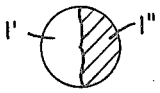
Figure 6B:
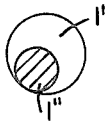
Figure 6C:
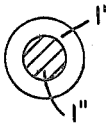
Figure 7:
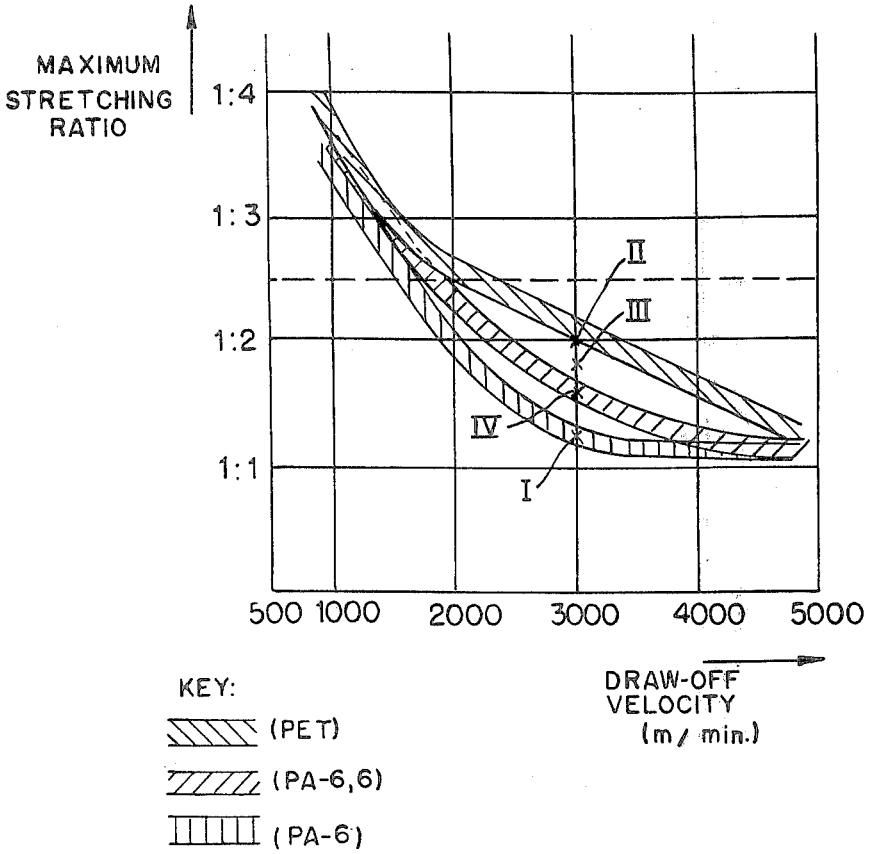

Various embodiments of the invention are described by way of example in the following description taken with reference to the accompanying drawings, wherein:

FIG. 1 schematically illustrates a spinning and stretching installation using conventional elements of apparatus;

FIG. 1*a* schematically illustrates a spinneret used for spinning bicomponent filaments;

FIG. 2 schematically illustrates a stretching apparatus equipped with a curved heating plate between feed and draw means;

FIG. 3 schematically illustrates a false-twist crimping machine;

FIG. 4 illustrates an edge wheel for producing preselected breakage points at regular intervals along the yarn;

FIGS. 5*a* and 5*b* illustrate individual filaments arranged symmetrically in a yarn or tow;

FIGS. 6*a*, 6*b* and 6*c* illustrate bicomponent filamentary structures of different types; and FIG. 7 illustrates in the form of a graph the maximum stretching ratios of polyethylene terephthalate (PET) as a polyester and the polyamides nylon-6 (PA-6) and nylon-6,6 (PA-6,6) in dependence upon the draw-off rates.

In the spinning and stretching installation shown in FIG. 1, the individual filaments 1 are spun from different polymers 1′ and 1″ separated by distributor plates 2 through a suitable spinneret or spinning plate 3. FIG. 1 thus illustrates the production of a yarn or tow T in which each individual filament consists of only one polymer. Individual filaments may be spun from different polymers or copolymers such as are also used in making bicomponent or multicomponent filaments, these latter sometimes being referred to as "composite filaments" to distinguish them from single polymer filaments. Polyethylene terephthalate and well known modifications thereof, including copolymers, is preferred as a linear polyester filament. Polycaprolactam as nylon-6 and polyhexamethylene adipamide as nylon-6,6 are especially preferred linear polyamides, including their copolymers with each other or with other modifying monomers as are generally known in this art. The term "different polymers" refers exclusively to the linear properties of molecular orientation as affected by the same conditions of spinning and stretching. In general, one selects polymers having different chemical structure as well as different linear properties, but the present invention offers a wide choice of suitable polymers and copolymers.

The distributor plate or plates 2 used to separate the polymers in FIG. 1 are arranged in such a way that the individual filaments of one polymer surround the individual filaments of the other polymer symmetrically on at least two sides. Compare FIGS. 5*a* and 5.

The invention is also applicable to yarns or tows which consist only of individual multicomponent and especially bicomponent filaments. Spinning heads as shown in FIG. 1*a* for producing multicomponent filaments are already known. Among the earlier patent literature on this subject, reference is made to U.S. Pat. No. 2,386,173. Above all, multicomponent filaments with a side-by-side arrangement or with a core/mantale arrangement of the components are possible. A spinning head 3′ of this kind as shown in FIG. 1*a* has one polymer 1′ supplied to the inner nozzles and a second polymer 1″ to the outer or face plate openings.

The freshly spun filaments are run off through the spinning duct 4, being cooled by air blown in through the duct 5, e.g. as a vertical chute enclosed on all four sides and open only at the bottom. In the embodiment illustrated, the freshly spun filaments are collected into a tow T which is lightly twisted by the twiester 7 with the twist running back in the direction of the spinneret or plate 3. Following the spinning duct 4 which defines a spinning zone 5, there is a preparation roller 6 on which the thread or tow is suitably impregnated with finishing or lubricating oils. The tow T is then drawn off by the godet 8 and crosswound into a bobbin package 10 by the traversing yarn or thread guide 9.

The yarn stretching apparatus shown in FIG. 2 comprises a spinning or feed bobbin, corresponding to cross-wound bobbin 10 of FIG. 1, from which the tow or yarn T is run off by a first pair of delivery rollers 11. The delivery rollers 11 are followed by a heating unit 12, e.g. a steam-heated curved plate 12′. The tow T is stretched by the stretching unit formed by the godet 13 and roller 13′ and is subsequently wound onto the receiving bobbin 14, again with the help of a traversing yarn guide 9′.

It is also possible here to use conventional draw-twisting machines in which the tow is wound onto a ring-twist twisting spindle. It is particularly emphasized that the stretching arrangement comprises only a single heating unit 12, even for the purpose of spinning and stretching linear polyesters. This is possible because it is only heavily preoriented polyester that is used. These strongly preoriented polyester filaments as required by the present invention are so highly resistant to heat that they can be processed under the same stretching conditions as nylon-6 or nylon-6,6 filaments. This constitutes a major advantage of the process according to the invention. Simultaneous use of polyester and nylon filaments under the same process conditions was not considered feasible prior to the development of this invention taken with my prior copending application Ser. No. 328,249, as incorporated hereinabove.

The false-twist crimping machine shown in FIG. 3 comprises a supply bobbin 14 from which the stretched tow T obtained as in FIG. 2 is run off by a first set of delivery rollers 15. The yarn or tow T is then guided over the heating unit 16 and false-twister 17 and is then taken off by the delivery rolls 18. It is possible and, in the case of one process according to the invention, of substantial advantage to carry out the stretching of the tow T between the delivery rollers 15 and 18 of a falsetwist crimping machine of the kind shown in FIG. 3, rather than in a stretching device alone as shown in FIG. 2.

In this case, the original spinning bobbin 10 as taken from FIG. 1 precedes the false-twist crimping machine shown in FIG. 3 and replaces the bobbin 14. This process becomes industrially workable and economically interesting only because the strongly preoriented filaments spun by this process can be transported much more effectively and stored for longer periods than non-preoriented filaments, something generally known in this art. In addition, the spinning packages of strongly preoriented filaments have considerably improved processibility. In particular, one need apply only relatively weak stretching forces.

The delivery or draw rollers 18 are followed by a second heating unit 19 on which the tow is subjected to still another heat treatment to reduce crimp contraction. The tow is run off by the delivery rollers 20 and wound onto the collecting bobbin 21 with predetermined elongation. The relative speeds or velocities V at the delivery rollers 15, 18, 20 and at the bobbin 21 are preferably set up as follows:

V2 is greater than V1;

V2 is greater than V3; and

V4 is greater than V3.

It is further pointed out that an edge wheel of the type shown in FIG. 4 can be provided in the stretching stage of a stretch machine or the draw-twist machine, i.e. between the delivery rollers 11 and the stretching unit 13 in FIG. 2 or between the feed rollers 15 and draw rollers 18 in FIG. 3. When the edge wheel rotates, the tow comes into contact with a radially projecting edge at certain regular or irregular intervals and, in this way, the filament component most strongly stressed in the stretching stage, e.g. up to its breaking point, is made to tear or break at a predetermined point. The edge wheel of FIG. 4 can be driven at a constant or at a fluctuating rotational speed, or it can even be driven solely by frictional contact with the advancing tow T.

FIGS. 5*a* and 5*b* show in a schematic manner cross-sections of yarns or tows in which the filaments of one component (B) are symmetrically surrounded by the fibers of the other component (A) at least on two sides as in FIG. 5*b*. The effect of this arrangement is that, through light pretwisting and/or suitable initial preparation, the individual filaments enter into a certain cohesive connection or joining in longitudinal or axial relationship with one another. As a result, the "longer" component is forced to wrap itself in turns or loops around the "shorter" component. It is pointed out that the individual filaments of type (A) and/or the individual filaments of type (B) can also be formed as self-crimping multicomponent filaments.

FIG. 6 shows possible structures or cross-sectional configurations of bicomponent filaments. It is again emphasized that the tow or yarn produced in accordance with the invention can be made up either of multicomponent filaments or of a mixture of multicomponent and single-component filaments.

FIG. 6*a* shows a bicomponent filament with the two polymer components 1′ and 1″ in a side-by-side arrangement.

FIGS. 6*b* and 6*c* show core/mantle arrangements of the two components 1′ and 1″, FIG. 6*c* showing a concentric core/mantle arrangement which can be used with a particularly advantageous effect in accordance with the present invention.

FIG. 7 graphically illustrates the maximum stretching ratios (recorded for a 167/32 dtex yarn) for polyethylene terephthalate (PET), nylon-6,6 (DA-6,6) and nylon-6 (PA-6), as examples of the fact that the maximum stretching ratios of the polymers initially coincide very closely with one another until the maximum stretching ratio is reduced to a value of 1:2.5 as dependent upon the degree of preorientation and the draw-off rate during spinning. These maximum stretching ratios then diverge considerably as preorientation increases with increasing draw-off speeds. The difference between the polymers can be enhanced by spinning the individual filaments of one polymer with a different denier than those of the other polymer. With a predetermined, common draw-off rate during spinning, macimum stretchability is increased in relation to the values shown in FIG. 7 for the filaments of coarser denier (larger diameter) and reduced for filaments of finer denier (smaller diameter). The graph also takes into consideration the fact that, in terms of absolute values, the maximum stretching ratios, i.e. those stretching ratios which result in breakage, cannot be defined precisely, but only within a tolerance band or range, especially since the maximum stretching ratios are also govered by factors other than the draw-off rate. It is to be emphasized that when a high level of preorientation is reached, corresponding to draw-off velocities above about 2,500–3000 up to about 4,500–5000 m/min., the otherwise observed dependence of the maximum stretching ratios upon the stretching temperature diminishes and almost disappears. As a result, the tolerance range or band narrows and the reliability of production of the process according to the invention thereby reaches a particularly high level.

It is in the nature of the preoriented polymers that certain tolerances must be accepted in the definition of the invention. As shown by the illustration in FIG. 7, however, the object of the invention which resides in the manufacture of a crimped and bulked yarn by first producing a strongly preoriented mixed or composite filament yarn, is fulfilled when a high preorientation is achieved that allows subsequent stretching of at most 1:2.5 in the spinning stage. The lower limit used for the stretching ratio is preferably based on the elastic limit of the preoriented filaments, i.e. such that at least one type of polymer filament of the mixed or composite filament yarn does not exceed its elastic limit during the stretching stage. In all cases, the stretching in this second stage after spinning must be maintained below the maximum stretching ratio of at least one of the different polymers.

As will be apparent from the graph of FIG. 7, the strongly preoriented mixed or composite filament yarn according to the invention can be stretched up to the maximum stretching ratio of one of the polymer components, so that the other polymer component is left behind with only a relatively low degree of stretching, provided that the preorientation is neither too high nor too low.

The invention is further illustrated by the following examples:

EXAMPLE 1

A 167/32 dtex mixed yarn of an equal number of polyester (PET) filaments and nylon-6 filaments was spun with an individual denier of 6.5 dtex and a draw-off rate of 3,000 m/minute. The mixed yarn was then stretched with a stretching ratio of 1:1.25 in a stretching apparatus of the kind shown in FIG. 2. During the stretching stage, the nylon-6 component did not show any signs of breakage. The operative point of the stretching stage is denoted by the reference numeral I in FIG. 7. The particular effect of this operative point responsible for crimping and bulking of the yarn is that the nylon-6 component can be fully stretched at a ratio of 1:1.25 so that optimum textile properties are imparted to it, while the polyester component under the same conditions will be only partly stretched, thereby having a marked tendency towards shrinkage and promoting a high degree of crimp and bulkiness of the final yarn product.

It was also found that the polyester component which had not been fully stretched also has a natural or inherent tendency towards crimping, e.g. so as to spontaneously crimp when stored in a relaxed state.

Example 1 represents but one aspect of the invention. According to a second aspect of the invention, the considerable difference between the maximum stretching ratios in the illustrated preorientation range (below a resulting maximum stretch ratio of 1:2.5 and down to about 1:1) is used to produce a yarn with a staple fiber appearance. To this end, stretching is continued in the next example beyond the maximum stretching ratio of one of the polymers.

EXAMPLE 2

The mixed yarn described in Example 1 was exposed to the stretching conditions of operative point II (FIG. 7) by being stretched in a ratio of 1:2 at a temperature of 200° C., using a stretching apparatus of the kind shown in FIG. 2. An edge wheel as shown in FIG. 4 was arranged between the delivery rollers 11 and the heating unit 12. This edge wheel was driven at a constant peripheral speed adapted to correspond to the rate of linear travel of the tow or yarn T. Since this stretching ratio of 1:2 lay above the maximum stretching ratio of the nylon-6 component, these nylon-6 filaments were torn into substantially staple lengths. The yarn thus obtained was subsequently twisted in a two-for-one twister and was very similar in its textile character to a yarn spun from staple fibers.

EXAMPLE 3

In a parallel test, the mixed yarn obtained in accordance with Example 1 was exposed to a stretching ratio of only 1:1.8 (operative point III in FIG. 7). As a result, it again assumed an appearance resembling that of a staple fiber yarn. However, the textile properties of the yarn thus obtained differed from those of the yarn obtained in accordance with Example 2 because the polyester component which was not fully stretched additionally showed a natural or inherent tendency towards crimping. For this reason, the yarn was much more voluminous (bulky) than the yarn of Example 2 and had a correspondingly lower tensile strength.

The yarns produced in accordance with Examples 1 to 3 were then further modified in regard to crimp and bulk by subjecting them to a false-twist treatment in an apparatus of the kind shown in FIG. 3 either on completion of stretching or simultaneously with the stretching.

The production of yarns from bicomponent individual filaments in accordance with this invention is carried out in substantially the same way as the production of mixed yarns with single-component filaments. The additional false-twist treatment in an apparatus of the kind shown in FIG. 3 is of particular advantage in the case of bicomponent filaments. Bicomponent filaments with a concentric core/mantle configuration can also be used with special advantage for this purpose.

EXAMPLE 4

A 167/36 dtex bicomponent filamentary yarn was spun at a draw-off rate of 3000 m/minute by simultaneously extruding a nylon-6,6 and a nylon-6 component in core/mantle form. Adhesion problems between the individual components did not arise by virtue of using the concentric core/mantle configuration of FIG. 6*c*. The spinning bobbin or package 10 thus obtained, as shown in FIG. 1, was mounted at the beginning of a false-twist crimping machine of the kind shown in FIG. 3. Stretching was carried out at a stretching ratio of 1:1.25 (operative point I in FIG. 7).

The rotational speed of the delivery rollers 18 and the rotational speed of the false-twist spindle 17 in FIG. 3 were adapted to one another in such a way that the yarn received a false-twist of 2200 T/m. The heating unit 16 had a temperature of 220° C. After passing through the delivery rollers 18, the yarn was wound onto the spool 21, by-passing the heating unit 19, at a rate 12% below the speed of rotation V2 of the delivery rollers 18. After it had been stored on the bobbin for only several days, the packaged filament showed a spontaneously developed crimp with a crimp contraction of 18%.

However, in this case, it was also possible to make use of the second aspect of the invention, i.e. wherein stretching is continued to beyond the maximum stretching ratio of one of the components, of the bicomponent filaments. This is illustrated in the following example:

EXAMPLE 5

A bicomponent yarn with a side-by-side configuration (FIG. 6*a*) of the two polymer components was spun by simultaneously extruding a nylon-6,6 as one polyamide component and a copolyamide of nylon-6 and nylon-6,6 as the other polyamide component. The draw-off rate amounted to 3000 m/minute and the spinning denier or yarn size was 250/32 dtex. This was followed by stretching at a ratio of 1:1.5 (operative point IV in FIG. 7). This largely resulted in tearing or breaking of the copolyamide (nylon-6 and nylon-6,6) filaments. Separation of the two components also occurred to a considerable extent. The yarn thus obtained had textile properties resembling those of a staple fiber yarn.

Other variations of the present invention can be readily accomplished by following the foregoing examples and description using readily available materials and apparatus.

The invention is hereby claimed as follows:

1. A process for the production of a multifilament texturized yarn which comprises:

simultaneously melt-spinning at least two different thermoplastic fiber-forming linear polymers selected from the group consisting of linear fiber-forming and crimpable polyesters and polyamides into a continuous preoriented multifilament tow containing the different polymer components under substantially the same spinning conditions for all portions as the tow including a draw-off from the spinning zone at a velocity of more than 2,500 meters/minute;

and then, in a second separate stage prior to any crimping, stretching the spun and solidified multifilament tow under substantially the same stretching conditions for all portions of the tow, said melt-spinning being carried out to achieve a preorientation which is so high that the available maximum stretching ratio of all the filamentary polymer components in the second stage amounts to not more than 1:2.5, and said stretching being carried out to exceed the elastic limit of at least one of the filamentary polymer components with the proviso that said stretching is maintained above the elastic limit but below the maximum stretching ratio of at least one of the filamentary polymer components while said stretching also extends beyond the maximum stretching ratio of at least another one of the filamentary polymer components to cause filament breakage.

2. A process as claimed in claim 1 wherein the initially melt-spun thermoplastic filaments are drawn off at a velocity of between about 2,700 and 5,000 meters/minute from the spinning zone.

3. A process as claimed in claim 1 wherein the initially melt-spun filaments are subjected to a quenching treatment as they are drawn off from the spinning zone.

4. A process as claimed in claim 1 wherein the initially melt-spun filaments are subjected to a quenching treatment as they are drawn off from the spinning zone.

5. A process as claimed in claim 1 wherein the initially melt-spun filaments are subjected to a quenching treatment as they are drawn off from the spinning zone.

6. A process as claimed in claim 1 wherein the stretching is maintained below the elastic limit of at least one of the different filamentary polymer components other than said at least one component for which the stretching is above the elastic limit but below the maximum stretching ratio and said at least another one component for which the stretching extends beyond the maximum stretching ratio.

7. A process as claimed in claim 1 wherein the multifilament tow is conducted in the stretching stage over a rotating edge wheel in which the radially extending edges of the wheel located at predetermined intervals when placed in running contact with the tow facilitate the breaking of said filamentary polymer components which are extended beyond their maximum stretching ratio.

8. A process as claimed in claim 1 wherein the individual spun filaments consist of one or the other of the different polymers, the filaments of one polymer surrounding the filaments of the other polymer on at least two sides of the multifilament tow.

9. A process as claimed in claim 1 wherein the multifilament tow is made up of both single-component and multicomponent filaments.

10. A process as claimed in claim 1 wherein the multifilament tow is composed of multi-component individual filaments having a concentric core and mantle structure of the different components.

11. A process as claimed in claim 1 wherein the multifilament tow is subjected to a false twist crimping treatment after the stretching stage.

12. A process as claimed in claim 11 wherein the multifilament tow is composed of multi-component individual filaments having a concentric core and mantle structure of the different components.

13. The product obtained by the process according to claim 1.

14. The product as claimed in claim 13 consisting essentially of two different filamentary polymer components, one of which has been stretched to exceed its elastic limit but not beyond its maximum stretching ratio and the other of which has been stretched beyond its maximum stretching ratio to cause filament breakage.

* * * * *

UNITED STATES PATENT AND TRADEMARK OFFICE

CERTIFICATE OF CORRECTION

PATENT NO. : 4,019,311

DATED : April 26, 1977

INVENTOR(S) : SCHIPPERS

It is certified that error appears in the above-identified patent and that said Letters Patent are hereby corrected as shown below:

In Column 13, Line 4, delete " ... in claim 1 ... " and substitute -- ... in claim 2 ... --

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*